US009687052B2

(12) United States Patent
Rosenberg

(10) Patent No.: US 9,687,052 B2
(45) Date of Patent: Jun. 27, 2017

(54) RESIZABLE RING

(71) Applicant: Spectore Corporation, Deerfield Beach, FL (US)

(72) Inventor: Edward Rosenberg, Delray Beach, FL (US)

(73) Assignee: Spectore Corporation, Deerfield Beach, FL (US)

( * ) Notice: Subject to any disclaimer, the term of this patent is extended or adjusted under 35 U.S.C. 154(b) by 0 days.

(21) Appl. No.: 14/791,821

(22) Filed: Jul. 6, 2015

(65) Prior Publication Data

US 2017/0006978 A1 Jan. 12, 2017

(51) Int. Cl.
*A44C 9/02* (2006.01)
*A44C 9/00* (2006.01)

(52) U.S. Cl.
CPC ..... *A44C 9/02* (2013.01); *A44C 9/0023* (2013.01)

(58) Field of Classification Search
CPC ..... A44C 5/105; A44C 9/0015; A44C 9/0038; A44C 27/002; A44C 27/00; A44C 9/0007; A44C 9/02; Y10T 29/21
USPC ..... 63/15, 15.5, 15.7; D11/26, 27
See application file for complete search history.

(56) References Cited

U.S. PATENT DOCUMENTS

| | | | | |
|---|---|---|---|---|
| 3,017,754 | A | 1/1962 | Manne | |
| 3,236,065 | A | 2/1966 | Gladding | |
| 3,237,426 | A | 3/1966 | Doering | |
| 3,238,741 | A | 3/1966 | Johnson | |
| 3,460,356 | A | 8/1969 | Lodrini | |
| 3,603,109 | A | 9/1971 | Virtanen | |
| 4,158,951 | A | 6/1979 | Cedar | |
| 4,223,541 | A | 9/1980 | Martinez | |
| 4,480,447 | A | 11/1984 | Lodrini | |
| 4,538,430 | A | 9/1985 | Parks | |
| 4,903,507 | A | 2/1990 | Gesensway | |
| 5,131,243 | A | 7/1992 | Coleman | |
| 5,136,858 | A | 8/1992 | Bruner | |
| 5,239,842 | A | 8/1993 | Gesensway | |
| 6,928,734 | B1 * | 8/2005 | West | A44C 9/00 29/896.412 |
| 2007/0125124 | A1 * | 6/2007 | South | A44C 9/0015 63/15.5 |

FOREIGN PATENT DOCUMENTS

| | | |
|---|---|---|
| EP | 1358814 | 11/2003 |

* cited by examiner

*Primary Examiner* — Jack W Lavinder
(74) *Attorney, Agent, or Firm* — Fleit Gibbons Gutman Bongini Bianco PL; Jon A. Gibbons

(57) ABSTRACT

An adjustable ring is constructed from a first material to form at least a portion of a substantially circular shape. The first material includes two first C-shaped distal halves, and two second C-shaped proximate halves, and each of the halves arranged together to form a vertically bisected O-shape with a top portion removed defining a first arcuate void portion and a bottom portion removed defining a second arcuate void portion. The ring also includes a second material created to fit inside each of the two first and two second C-shaped halves of the first material to form a substantially circular shape defining an inner diameter for a given ring size. The second material includes at least one stress relief point and at least one size bar formed therewith. The second material is created to fit inside the first material using one or more of casting, co-casting, machining, forging, and stamping.

9 Claims, 20 Drawing Sheets

RESIZABLE RING

PARTIAL WAIVER OF COPYRIGHT

All of the material in this patent application is subject to copyright protection under the copyright laws of the United States and of other countries. As of the first effective filing date of the present application, this material is protected as unpublished material. However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

BACKGROUND

The present invention generally relates to finger rings and bands, and more specifically to resizable finger ring.

Properly sized rings or bands provide a close-fitting, comfortable fit which allows the ring to be easily placed and removed from a wearer's finger, feel comfortable to the wearer, and not unintentionally slide off of the wearer's finger. Rings are initially sized to fit a particular finger of one wearer. However, if the physical characteristics of the wearer change, such as change in body weight or other growth of the wearer, or if the wearer desires to wear the ring on a different finger or give the ring to another person with different-sized fingers. The ring would either be too tight or too loose to be worn properly, if at all.

Known methods for altering the size of a ring involve cutting and removing, adding, or entirely replacing a portion of the shank of the ring. This process leaves an opening in the shank with two ends. Once the portion is removed, the shank is subjected to either; 1) compression, forcing the two ends together and then joining them, forming a smaller sized ring; or 2) expansion, forcing the two ends further apart and then joining a new, larger piece or additional material of material between them, forming a larger-sized ring. This is an expensive method which may causes mutilation of the ring, ruining its aesthetic beauty and decreasing its value. It also requires repeated mutilation if further adjustments in size are required.

To obviate this difficulty it has been suggested that an adjustable ring be constructed of multiple sections slidably linked together and provided with a spring arrangement for biasing the respective links into a position corresponding to the smallest of a range of sizes. Among the advantages attributed to these structures is the ability of the ring to adjust to the size of the finger of the wearer. The structures proposed in the prior art have been found to be impractical and thus have not come into any appreciable use by jewelry manufacturers.

Thus, there is a need for an adjustable finger ring which allows for easy and repeated expansion and contraction of a ring size and which does not contain numerous small parts which are easily lost or broken. The adjustments can be made and sized by jewelers without special skills or special equipment.

SUMMARY

In one example, an adjustable ring is constructed from a first material to form at least a portion of a substantially circular shape The first material includes two first C-shaped distal halves, and two second C-shaped proximate halves, and each of the halves arranged together to form a vertically bisected O-shape with a top portion removed defining a first arcuate void portion and a bottom portion removed defining a second arcuate void portion. The ring also includes a second material created to fit inside each of the two first and two second C-shaped halves of the first material to form a substantially circular shape defining an inner diameter for a given ring size that the second material including at least one stress relief point or section with ductile material and at least one size bar formed therewith. Typically, one or more gems are attached to the second material with one of the gem stones positioned to fit inside the first arcuate void. In another example, the ring does not include gems. The second material is created to fit inside the first material using any of casting, co-casting, machining, extruding forging, gluing, joining, riveting, stamping, welding, or a combination thereof. The size bar is sized to fit within the second arcuate void portion of the first material.

In another example, a resizable ring is constructed from a first material created to form at least a portion of a substantially circular shape from a first C-shaped half, and a second C-shaped half. Each of the C-shaped halves arranged together form a vertically bisected O-shape with a top portion removed defining a first arcuate void portion and a bottom portion removed defining a second arcuate void portion. The first material is created with an outer circumference. A second material, with at least one stress relief point or section with ductile material, is created inside each of the i) first arcuate void portion of the first material and a portion along the outer circumference of the first material, and ii) the second arcuate void portion of the first material defining at least one size bar. Typically, one or more gems are attached to the second material with one of the gem stones positioned to fit inside the first arcuate void. In another example the ring does not include gems. The second material is created to fit inside the first material using any of casting, co-casting, machining, extruding forging, gluing, joining, riveting, stamping, welding, or a combination thereof.

In one example the first material is a contemporary material defined as at least one of one carbide, ceramic, chrome cobalt, niobium, platifina, rhodium, steel, stainless steel, surgical stainless steel, titanium, tantalum, tungsten, zirconium, or a combination thereof. The second material is a ductile metal defined as at least one of brass, bronzed, copper, gold, palladium, platinum, silver, steel, alloys or a combination thereof.

By using this construction the size bar of the resizable ring can be modified or replaced by cutting, soldering, welding and allowing the second material to expand or contract a few ring sizes while not changing the first material.

BRIEF DESCRIPTION OF THE DRAWINGS

The accompanying figures wherein reference numerals refer to identical or functionally similar elements throughout the separate views, and which together with the detailed description below are incorporated in and form part of the specification, serve to further illustrate various embodiments and to explain various principles and advantages all in accordance with the present invention. The use of the dotted fill denotes a second type of material in those regions as compared with a first type of material in those region(s) that have no fill, in which.

DETAILED DESCRIPTION

Figure 1:
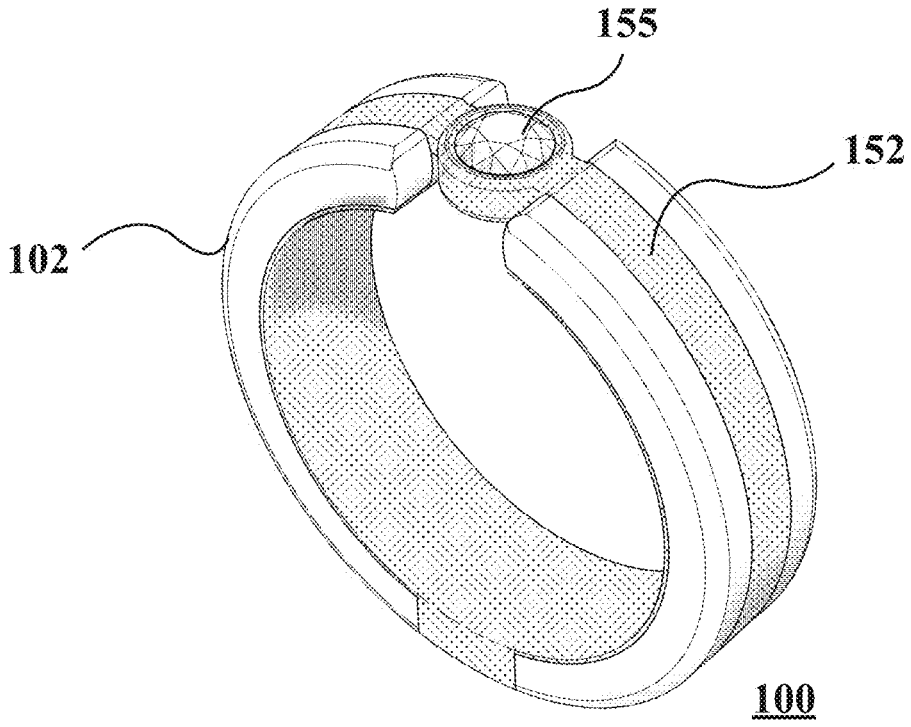
FIG. 1 is a top elevational view of a first example of a resizable ring.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further the terms and phrases used herein are not intended to be limiting, but rather, to provide an understandable description of the concepts.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated. The terminology used herein is for the purpose of describing particular embodiments only and is not intended to be limiting of the invention.

NON-LIMITING DEFINITIONS

The terms "a", "an" and "the" are intended to include the plural forms as well, unless the context clearly indicates otherwise.

The term "band" or "ring"" is used to mean a circular or spherical band typically worn on fingers and toes as an ornament or symbol of engagement, accomplishment, or authority. The band is typically made of precious metal and often set with one or more gems or gemstones.

The term "co-casting"" or "bi-metal casting"" is used to mean a casting one or more metals into a base metal. The base metal generally or often has higher melting points than the ductile metal used for accents. The base metal, typically a contemporary metal, is first cast but may also be machined, struck, molded, or otherwise created. Next the mold, usually made from wax, is added directly to the finished contemporary metal casting. The ductile metal is cast, or otherwise created and joined (that is machined, forged, stamped or had made) directly to the contemporary metal casting by co-casting, mechanical attachment, or otherwise affixing (pinning, gluing, swaging, setting or other). An example of co-casting metal is described in U.S. patent application Ser. No. 14/183,357 by Edward Rosenberg, field on Feb. 18, 2014, entitled "Co-Casting Precious Metal to An Alternative Material" and based on U.S. Provisional Patent Application No. 61/766,096 by Edward Rosenberg, filed on Feb. 18, 2013, each of these patent applications are hereby incorporated by reference hereinto in their entirety.

The terms "comprises" and/or "comprising", when used in this specification, specify the presence of stated features, steps, operations, elements, and/or components, but do not preclude the presence or addition of one or more other features, steps, operations, elements, components, and/or groups thereof.

The term "contemporary material" is used to mean a family of refractory or other hard metals, alloys or composites commonly known in the jewelry industry as "alternative" or "contemporary" including chrome cobalt, niobium, platifina, rhodium, stainless steel, surgical stainless steel, titanium, tantalum, tungsten, zirconium, alloys, or a combination thereof. Contemporary metal includes any other metals, alloys, plastics, and composites that are capable of acting as a base metal for co-casting and are highly compatible with the skin while highly durable.

The term "created" such as "created to form" or "created inside" means casting, co-casting, extruding forging, gluing, joining, machining, riveting, stamping, welding, or a combination thereof.

The term "ductile metal" means materials that can be stretched, bent, deformed, hammered, soldered, welded or otherwise joined together or to itself. Examples of ductile metal or malleable materials include brass, bronze, copper, gold, palladium, platinum, silver, steel, alloys, or a combination thereof.

The term "gem" means precious or semiprecious stone that is usually cut and polished.

The term "resizable" means to alter either to enlarge or decrease the inside circumference of a band.

The term "ring size" is a measurement used to denote the inner circumference of a ring. There are various systems and scales used. The ISO scale defines ring size in terms of inner circumference of the ring measured in millimeters. In the United States the ring size is denoted by a numerical scale, with quarter and half sizes. For example, an increase of a full size is an increase of approximately 0.032 inches (0.8128 mm) in diameter.

The term "sizing bar" means a removable or sizable insert in a band. The size bar may be replaced or just cut and adjusted in size. In one example, there may be prefabricated size replaceable bars of a given size.

The term "stress relief point" or "hinge" means notch, groove, slit, designated bend area, such as a thinner area, or other void to enable the ring size to be enlarged or decreased when the size bar is altered. Through the use of a stress relief point the ductile material is allowed to help predetermine the area to deform into one of several ring sizes without cracking or snapping.

The term "traditional metal" is typically a "ductile metal" including brass, bronze, copper, gold, palladium, platinum, silver, steel, alloys, or a combination thereof.

Overview

The present invention enables anyone with basic jewelry skills and equipment, such as a torch and saw, to size rings larger and smaller without damaging or significantly altering the product. Unlike conventional rings the present invention eliminates the need for replacement or the use of specialized equipment and expertise specific to the materials or setting formats.

Among the advantages realized in accordance with the present invention are complete compatibility with present techniques for ornamenting rings (i.e., setting stones, polishing and the like), and ready replaceability of a size bar. The ring itself is exceptionally suited to the needs of the wearer, both aesthetically and functionally. It is possible to ornament the ring in a manner which virtually obscures the fact that the same is adjustable.

Dotted Fill Convention in Drawings

The use of dotted fill in regions of all the drawings denotes a contemporary material or the "first material" in the language of the claims. The region(s) of the drawings without a dotted fill denotes traditional metal of the "second material" in the language of the claims.

First Example of Resizable Ring

Figure 2:
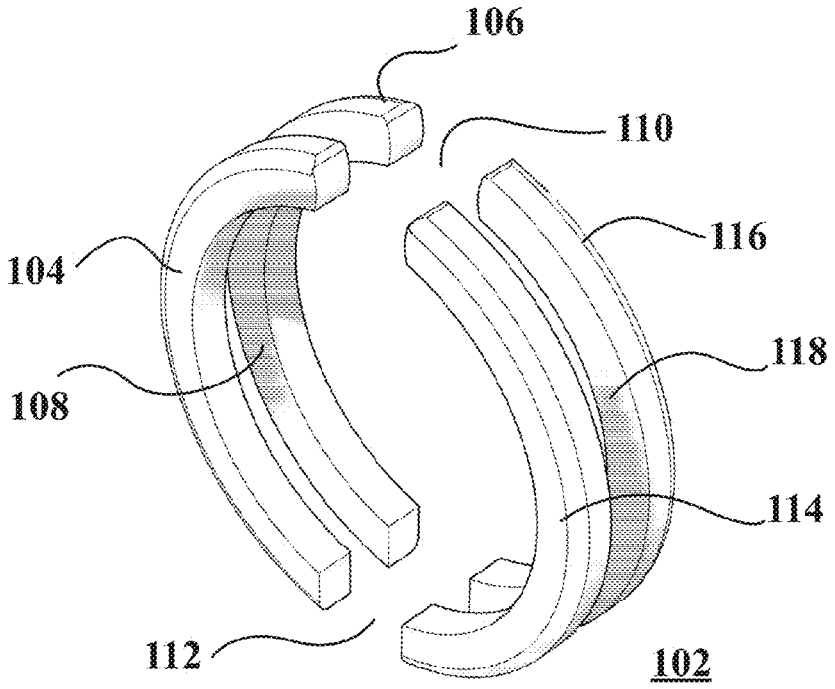
FIG. 2 is a perspective view of a first type material of FIG. 1.

FIG. 1 is a top elevational view of a first example of a resizable ring 100. Shown are two types of materials. The first type of material 102 is a contemporary material. The second material 152 is a traditional metal. The traditional metal has a gem 155 attached to it. Turning to FIG. 2, shown is a perspective view 102 of a first type material of FIG. 1. The first material 102 is created in a portion of a substantially circular shape. There are two first C-shaped distal halves 106, 116. Also there are two second C-shaped proximate halves 104, 114. A space 108, 118 separate each of the distal-proximate sides. As shown, each of the halves arranged together to form a vertically bisected O-shape with a top portion removed defining a first arcuate void portion 110 and a bottom portion removed defining a second arcuate void portion 112.

Figure 3:
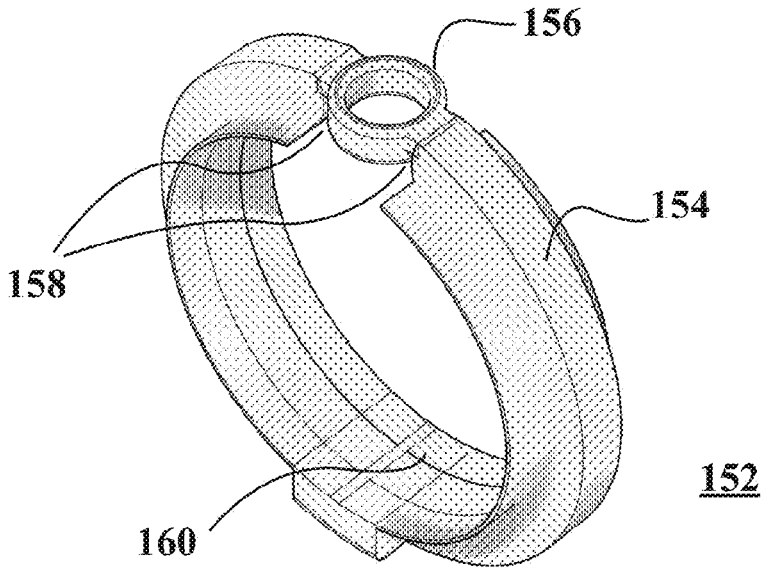
FIG. 3 is a perspective view of a second type material of FIG. 1.

FIG. 3 is a perspective view of a second type material 152 of FIG. 1. The second material is created in a substantially circular shape and defines an inner diameter or inner circumference of a given ring size. The second material 152 is created to fit inside the space 108, 118 of each of the two first and two second C-shaped halves 104, 106, 114, 116 of the first material 102.

The second material includes two stress relief points 158 around the mount 156 located at a 12 o'clock position for the gem 155. In this example the mount 156 is sized to fit inside the first arcuate void portion of the first material 102. The mount 156 may be fastened to the second material 152 by casting, co-casting, machining, extruding forging, gluing, joining, riveting, stamping, welding, or a combination thereof.

Note the size bar 160 is sized to fit within the second arcuate void portion 112 of the first material 102 at the 6 o'clock position.

The second material 152 can be created to fit inside the space 108, 111 by casting, co-casting, machining, extruding forging, gluing, joining, riveting, stamping, welding, or a combination thereof.

Second Example of Resizable Ring

Figure 4:
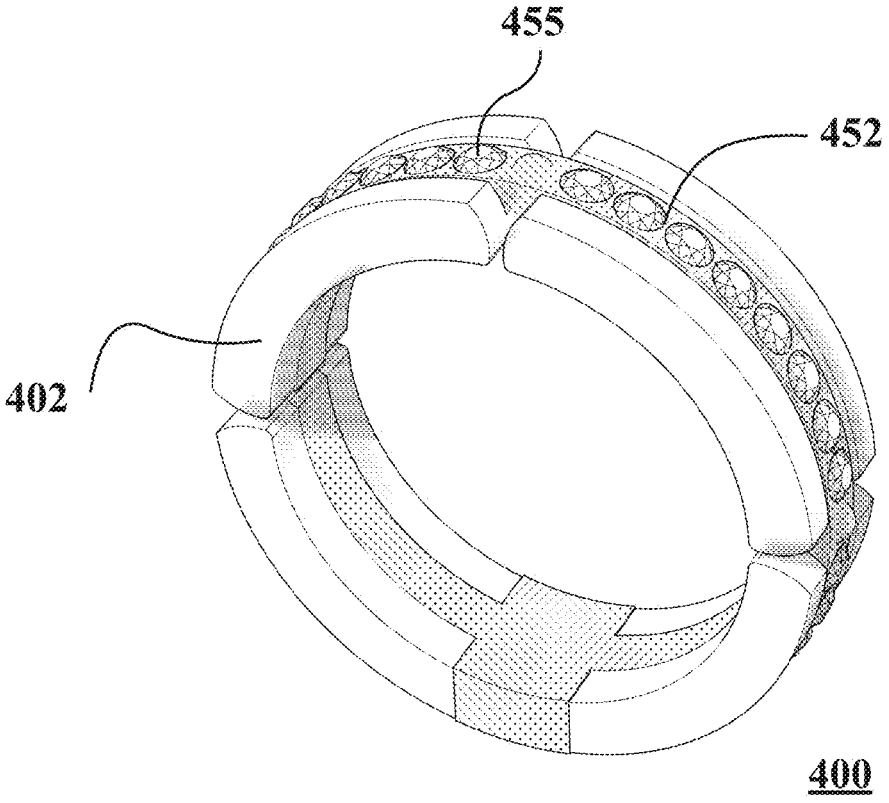
FIG. 4 is a top elevational view of a second example of a resizable ring.
Figure 5:
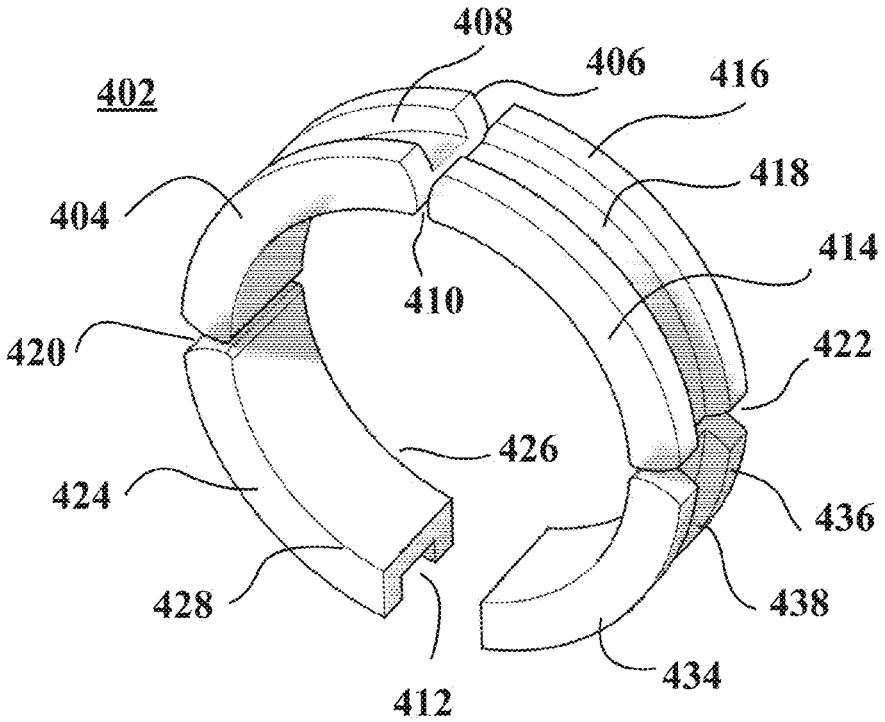
FIG. 5 is a perspective view of a first type material of FIG. 5.

FIG. 4 is a top elevational view of a second example of a resizable ring 400. Shown are two types of materials. The first type of material 402 is a contemporary material. The second material 452 is a traditional metal. The traditional metal has a gem 455 attached to it. Turning to FIG. 5, shown is a perspective view 402 of a first type material of FIG. 4. The first material 402 is created in a portion of a substantially circular shape. There are two first C-shaped distal halves 406, 416, 426, 436. Also there are two second C-shaped proximate halves 404, 414, 424, 434. A channel 408, 418, 428, 438 joins each of the distal-proximate sides 404 with 406, 414 with 416, 424 with 426, and 434 with 436 Like the first example, each of the halves arranged together to form a vertically bisected O-shape with a top portion removed defining a first arcuate void portion 410 and a bottom portion removed defining a second arcuate void portion 412. In this second example there is a horizontally bisected O-shape with the left portion removed defining a third arcuate void portion 420, and a right portion removed defining a fourth arcuate void portion 422.

Figure 6:
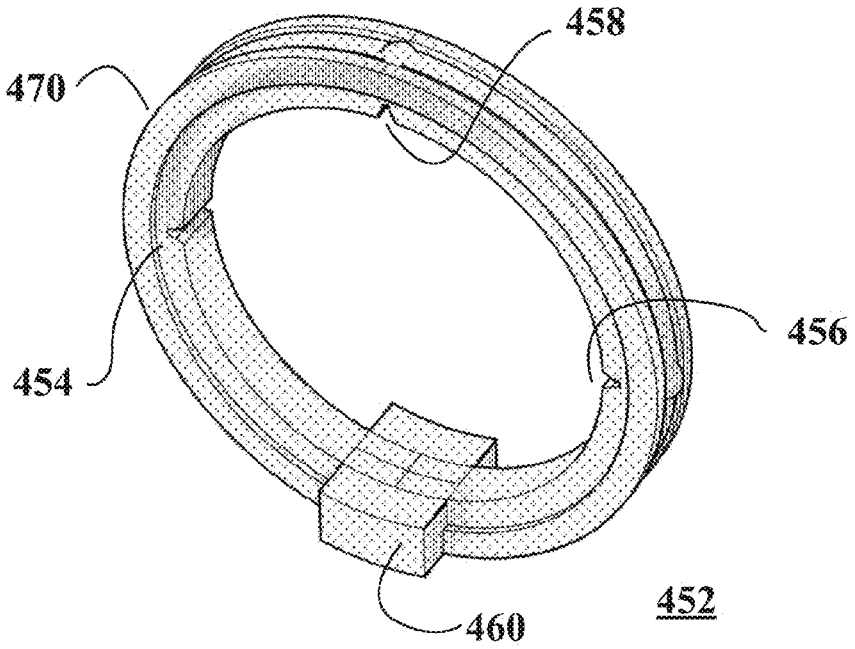
FIG. 6 is a perspective view of a second type material of FIG. 5.

FIG. 6 is a perspective view of a second type material 452 of FIG. 4. The second material is created in a substantially circular shape and defines an inner diameter or inner circumference of a given ring size. The second material 452 is created to fit inside the channel 408, 418, 428, 438 of each of the two first and two second C-shaped halves 404, 406, 414, 416, of the first material 402.

The second material includes three stress relief points 454, 456, 458 at a 9 o'clock position, 12 o'clock position, and 3 o'clock position (90, 180, 270 degrees starting from the bottom). In this example the mounts 452 with gems 455 sized to fit inside the channel 408, 418, 428, 438 of the first material 402. The mount 456 may be fastened to the second material 452 by casting, co-casting, machining, extruding forging, gluing, joining, riveting, stamping, welding, or a combination thereof.

Note the size bar 460 is sized to fit within the second arcuate void portion 412 of the first material 402 at the 6 o'clock position.

The second material 452 can be created to fit inside the channel 408, 418, 428, 438 and second arcuate void portion 412 by casting, co-casting, machining, extruding forging, gluing, joining, riveting, stamping, welding, or a combination thereof.

Third Example of Resizable Ring

Figure 7:
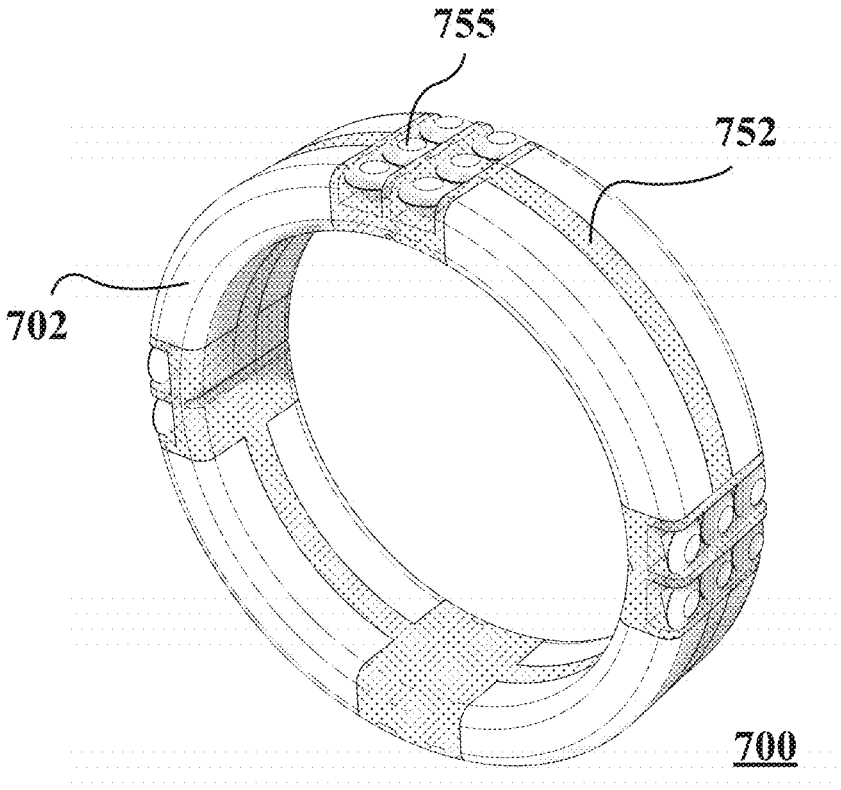
FIG. 7 is a top elevational view of a third example of a resizable ring.
Figure 8:
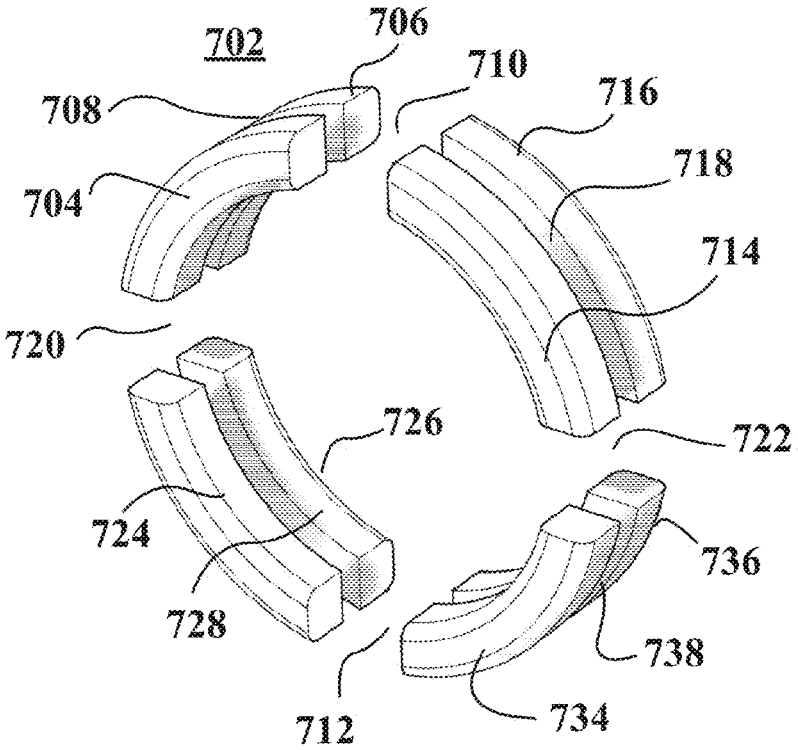
FIG. 8 is a perspective view of a first type material of FIG. 7.

FIG. 7 is a top elevational view of a third example of a resizable ring 700. Shown are two types of materials. The first type of material 702 is a contemporary material. The second material 752 is a traditional metal. The traditional metal has a gem 755 attached to it. Turning to FIG. 8 shown is a perspective view 702 of a first type material of FIG. 7. The first material 702 is created in a portion of a substantially circular shape. There are two first C-shaped distal halves 706, 716, 726, 736. Also there are two second C-shaped proximate halves 704, 714, 724, 734. A space 708, 718, 728, 738 between each of the distal-proximate sides 704 and 706, 714 and 716, 724 with 726, and 734 with 736. Like the second example, each of the halves arranged together to form a vertically bisected O-shape with a top portion removed defining a first arcuate void portion 710 and a bottom portion removed defining a second arcuate void portion 712. Again, like the second example there is a horizontally bisected O-shape with the left portion removed defining a third arcuate void portion 720, and a right portion removed defining a fourth arcuate void portion 722.

Figure 9:
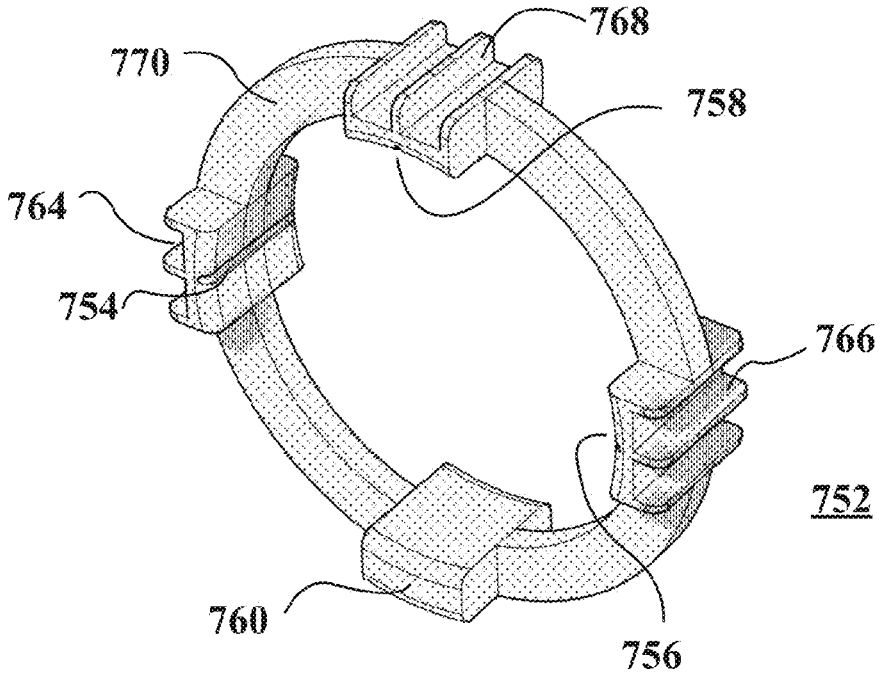
FIG. 9 is a perspective view of a second type material of FIG. 7

FIG. 9 is a perspective view of a second type 752 material of FIG. 6. The second material is created in a substantially circular shape and defines an inner diameter or inner circumference of a given ring size. The second material 752 is created to fit inside the space 708, 718, 728, 738 of each of the two first and two second C-shaped halves 704, 706, 714, 716 of the first material 702.

The second material includes three stress relief points 754, 756, 758 located at a 9 o'clock position, 12 o'clock position, and 3 o'clock position (90, 180, 270 degrees starting from the bottom). In this example the mounts 764, 766, 768 near the stress points 754, 756, 758. The mounts 764, 766, 768 hold firmly gems 755. The mounts 764, 766, 768 are sized to fit inside the first, third, and fourth arcuate void portions 710, 720, 722 of the first material 702. The mount 756 may be fastened to the second material 752 by casting, co-casting, machining, extruding forging, gluing, joining, riveting, stamping, welding, or a combination thereof.

Note the size bar 760 is sized to fit within the second arcuate void portion 712 of the first material 702 at the 6 o'clock position.

The second material 752 can be created to fit inside the space 708, 718, 728, 738 and second arcuate void portion 712 by casting, co-casting, machining, extruding forging, gluing, joining, riveting, stamping, welding, or a combination thereof.

Fourth Example of Resizable Ring

Figure 10:
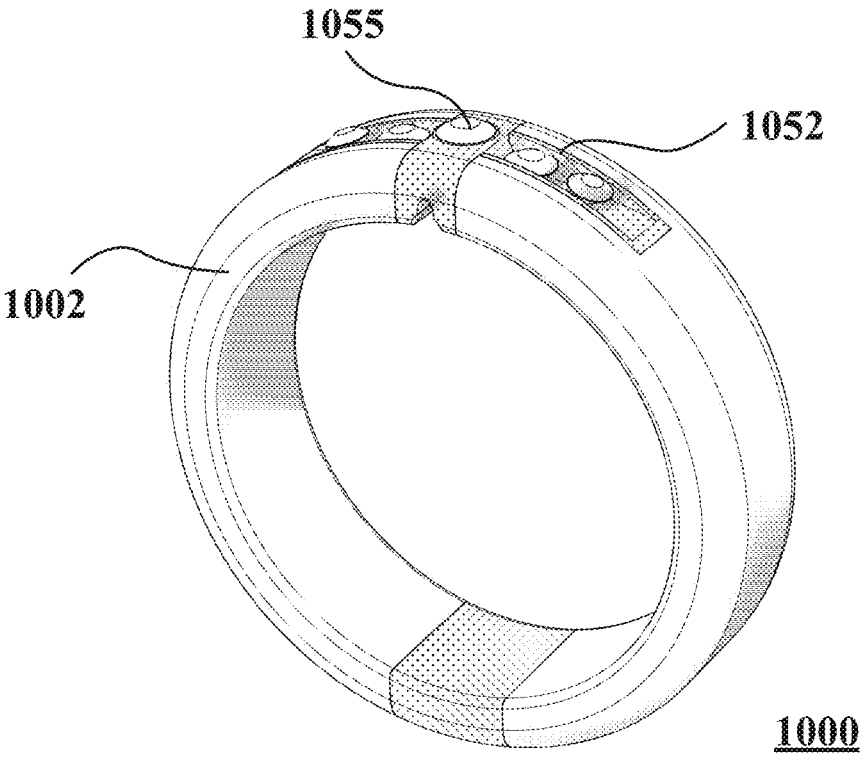
FIG. 10 is a top elevational view of a fourth example of a resizable ring.
Figure 11:
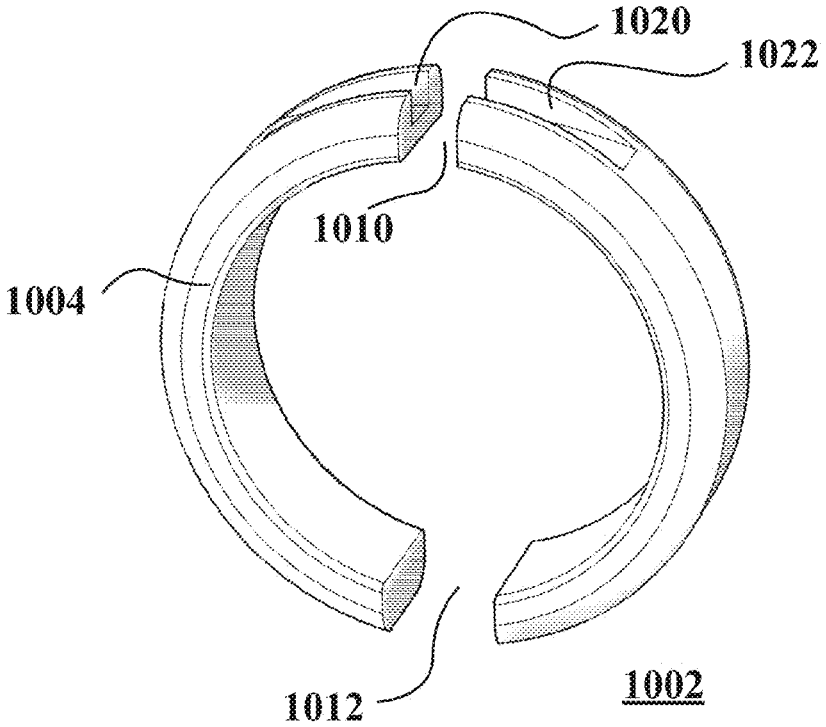
FIG. 11 is a perspective view of a first type material of FIG. 10.
Figure 12:
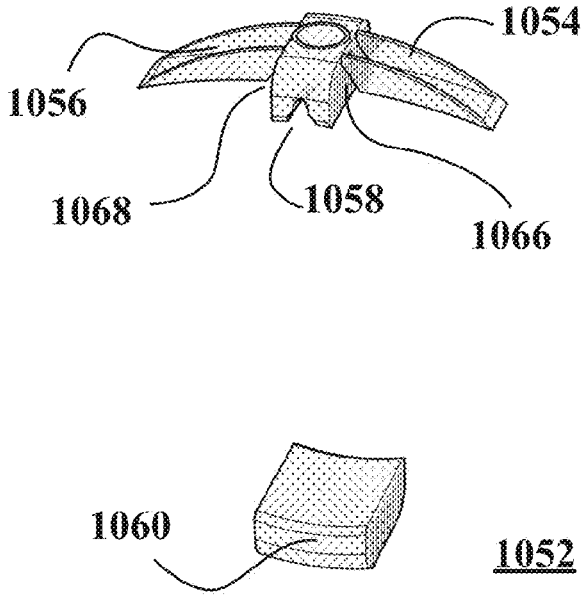
FIG. 12 is a perspective view of a second type material of FIG. 10.

FIG. 10 is a top elevational view of a fourth example of a resizable ring 1000. Shown are two types of materials 1002 and 1052. The first type of material 1002 is a contemporary material. The second material 1052 is a traditional metal. The traditional metal has a gem 1055 attached to it. Turning to FIG. 11, shown is a perspective view 1002 of a first type material of FIG. 10. The first material 1002 is created in a portion of a substantially circular shape. There are two first C-shaped halves 1004, 1006. As shown, each of the halves arranged together to form a vertically bisected O-shape with a top portion removed defining a first arcuate void portion 1010 and a bottom portion removed defining a second arcuate void portion 1012. The channels 1020, 1022 is formed in a top portion near the first arcuate void portion 1010 as shown.

Figure 14:
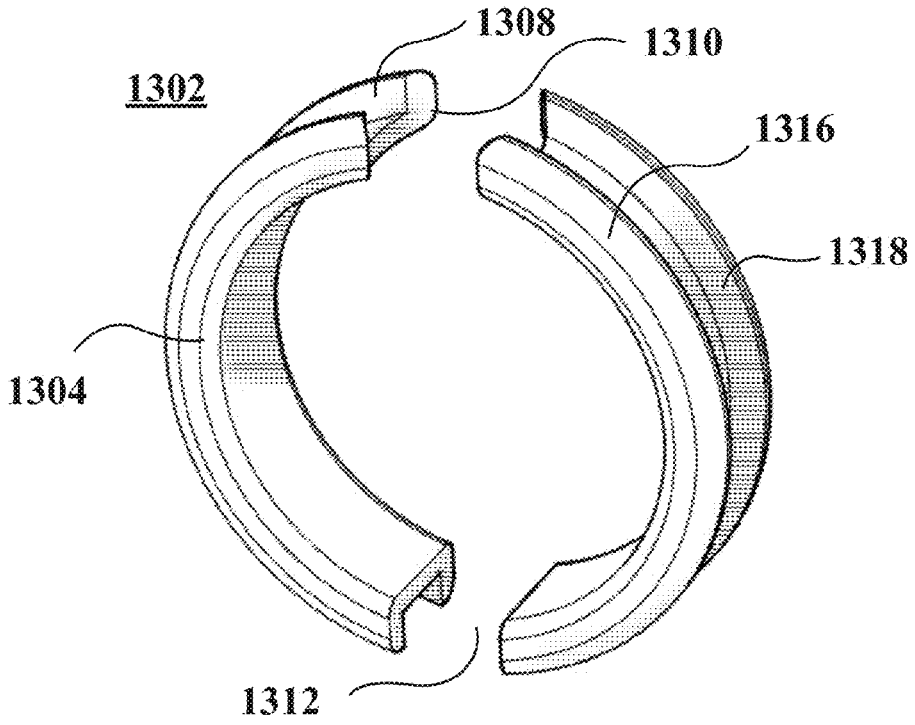
FIG. 14 is a perspective view of a first type material of FIG. 13.

FIG. 14 is a perspective view of a second type material 1052 of FIG. 10. The second material is formed in a bottom part and a top part. The bottom part is a size bar 1060 sized to fit within the second arcuate void portion 1012. The top part is an arcuate shape portion 1056, 1054 sized to fit within the channels 1020, 1022 of the first material 1002. The top portion includes one or more stress relief points 1058 at a 12 o'clock position for the gem 1055. Also shown is a pair of sides 1068, 1066 to fit within the first arcuate void portion 1010 at the 12 o'clock position.

The second material 1052 can be created to fit inside the space 1008, 1011 by casting, co-casting, machining, extruding forging, gluing, joining, riveting, stamping, welding, or a combination thereof.

Fifth Example of Resizable Ring

Figure 13:
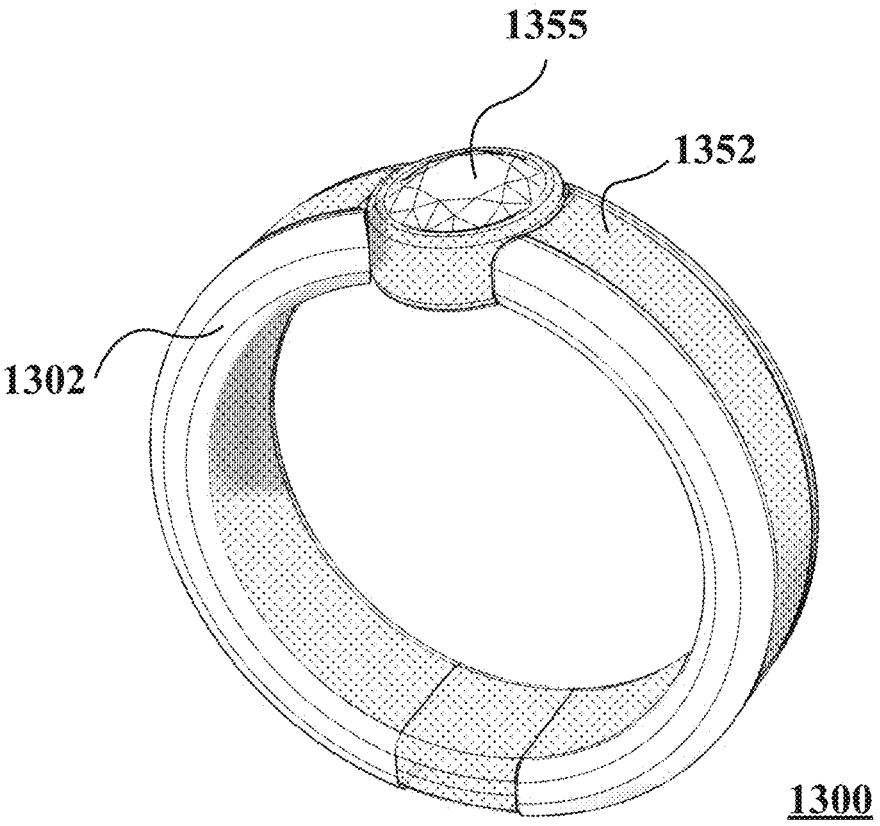
FIG. 13 is a top elevational view of a fifth example of a resizable ring.
Figure 15:
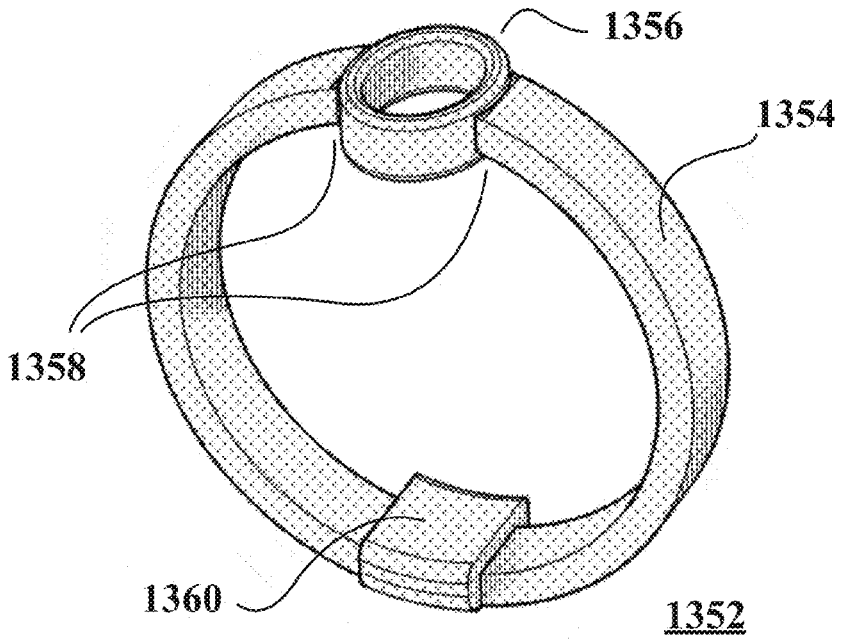
FIG. 15 is a perspective view of a second type material of FIG. 13.

FIG. 13 is a top elevational view of a fifth example of a resizable ring 1300. Shown are two types of materials 1302 and 1352. The first material 1302 is a contemporary material. The second material 1352 is a traditional metal. The traditional metal has a gem 1355 attached to it. Turning to FIG. 14, shown is a perspective view 1302 of a first type material of FIG. 13. The first material 1302 is created in a portion of a substantially circular shape and defines an inner diameter or inner circumference of a given ring size. There are two first C-shaped halves 1304, 1306. As shown, each of the halves arranged together to form a vertically bisected O-shape with a top portion removed defining a first arcuate void portion 1310 and a bottom portion removed defining a second arcuate void portion 1312. The channels 1308, 1318 is formed within the C-shaped halves 1304, 1306 as shown. FIG. 15 is a perspective view 1352 of a second type material of FIG. 13. The second material 1352 is created in a substantially circular shape. The second material is formed in a bottom part and a top part. The bottom part is a size bar 1360 sized to fit within the second arcuate void portion 1312. The mount 1356 for a gem 1355 sized to fit within first arcuate void portion 1310 of the first material 1302. The second material 1352 includes two stress relief points 1158 at a 12 o'clock position on either size of the mount 1356 for the gem 1355. Also shown is a pair of sides 1168, 1166 to fit within the first arcuate void portion 1110 at the 12 o'clock position.

The second material 1352 can be created to fit inside the channels 1308, 1310, 1312, 1318 by casting, co-casting, machining, extruding forging, gluing, joining, riveting, stamping, welding, or a combination thereof.

Sixth Example of Resizable Ring

Figure 16:
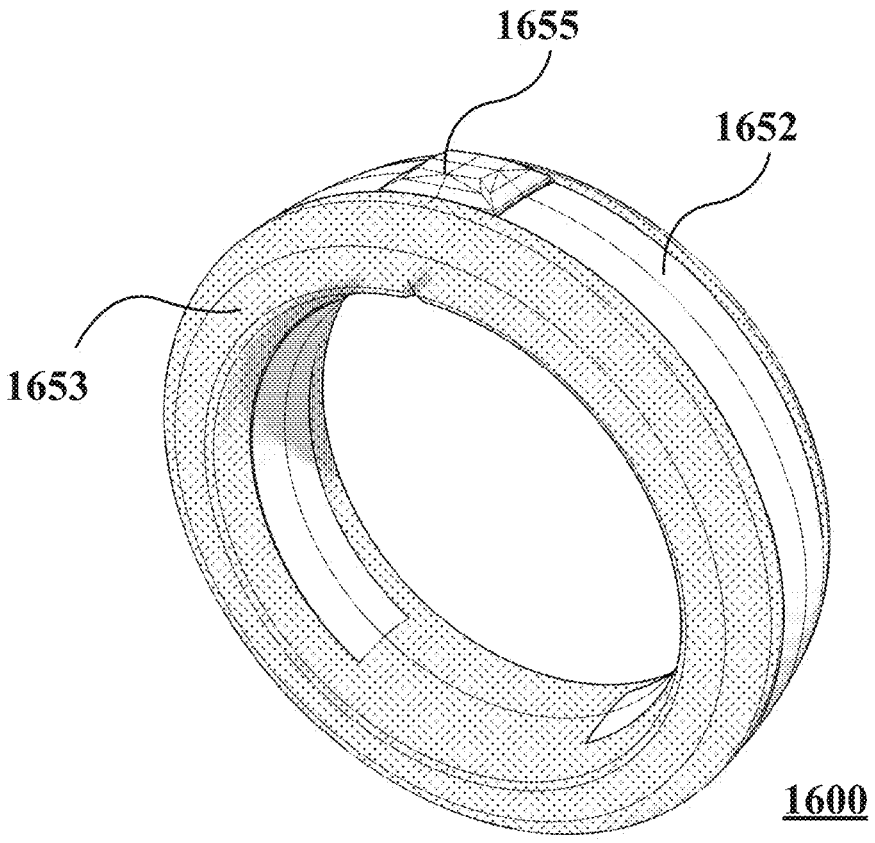
FIG. 16 is a top elevational view of a sixth example of a resizable ring.
Figure 17:
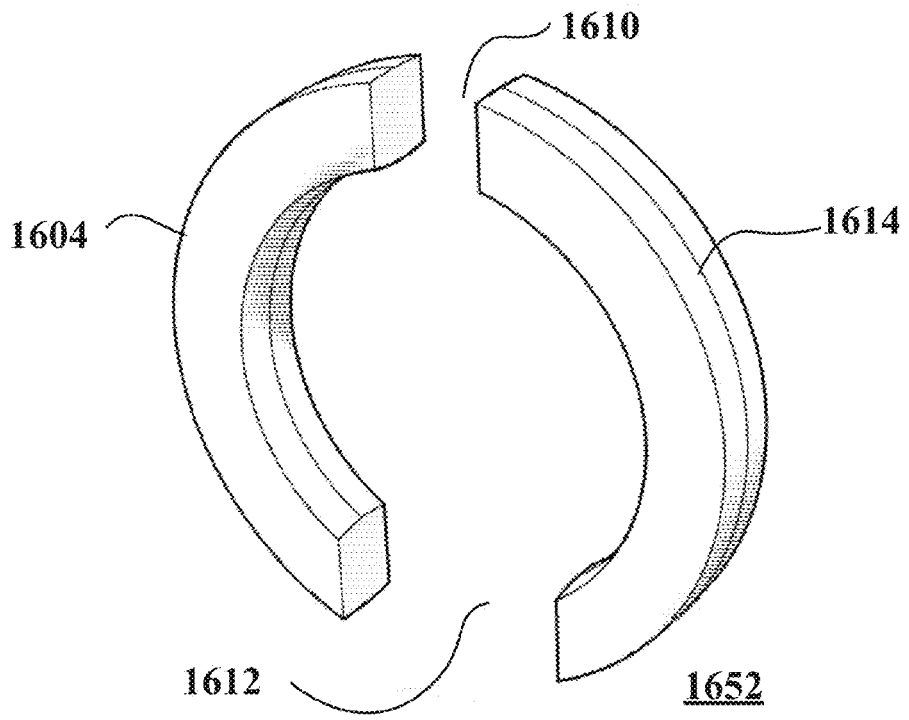
FIG. 17 is a perspective view of a first type material of FIG. 16.
Figure 18:
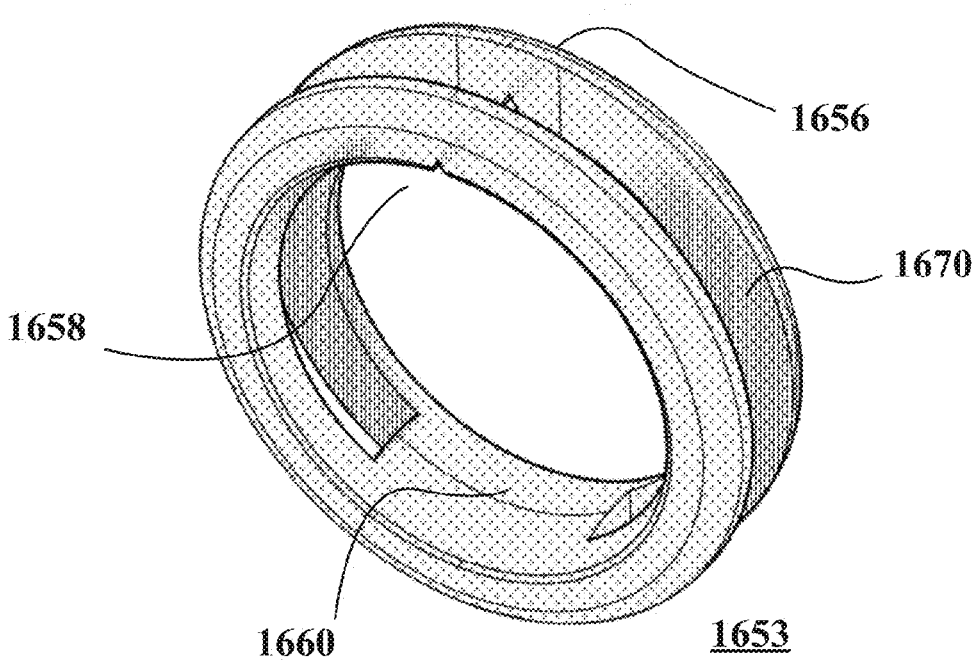
FIG. 18 is a perspective view of a second type material of FIG. 16.

FIG. 16 is a top elevational view of a sixth example of a resizable ring 1600. Shown are two types of materials 1602 and 1652. The first material 1602 is a contemporary material. The second material 1652 is a traditional metal. The traditional metal has a gem 1655 attached to it. Turning to FIG. 17, shown is a perspective view 1602 of a first type material of FIG. 16. The first material 1602 is created in a portion of a substantially circular shape. There are two first C-shaped halves 1604, 1606. As shown, each of the halves arranged together to form a vertically bisected O-shape with a top portion removed defining a first arcuate void portion 1610 and a bottom portion removed defining a second arcuate void portion 1612. FIG. 18 is a perspective view 1652 of a second type material of FIG. 16. The second material 1652 is created in a substantially circular shape and defines an inner diameter or inner circumference of a given ring size. The second material is formed as a substantially circular shape with an outside perimeter channel 1670. The bottom part is a size bar 1660 sized to fit within the second arcuate void portion 1612. The mount 1656 for a gem 1655 sized to fit within first arcuate void portion 1610 of the first material 1602. The second material 1652 includes a stress relief point 1658 at a 12 o'clock position near the mount 1656 for the gem 1655.

The second material 1652 can be created to around the first material 1610 by casting, co-casting, machining, extruding forging, gluing, joining, riveting, stamping, welding, or a combination thereof.

Seventh Example of Resizable Ring

Figure 19:
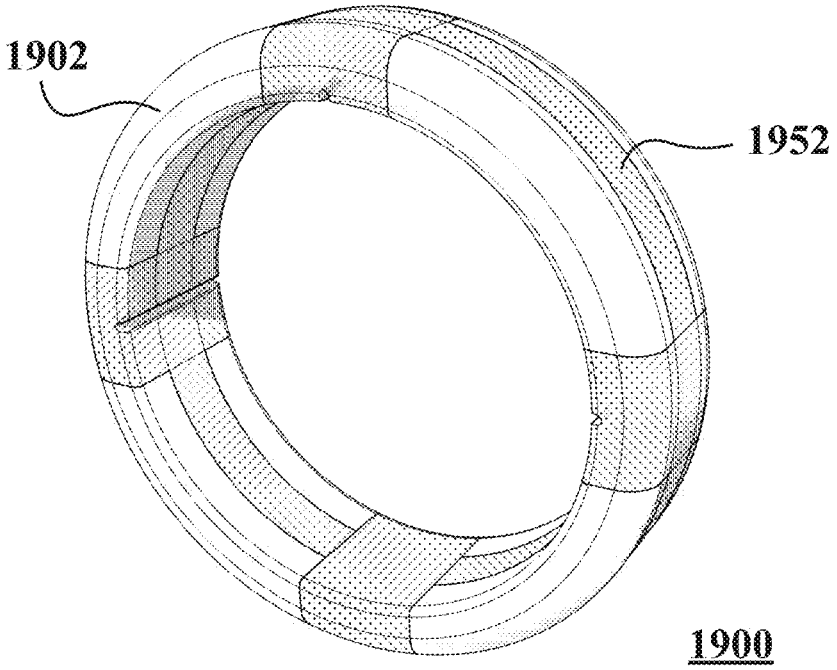
FIG. 19 is a top elevational view of a seventh example of a resizable ring.

FIG. 19 is a top elevational view of a seventh example of a resizable ring 700. In this example, there are no gems or stones. As with all these examples, gems or stoned may be added or removed.

Figure 20:
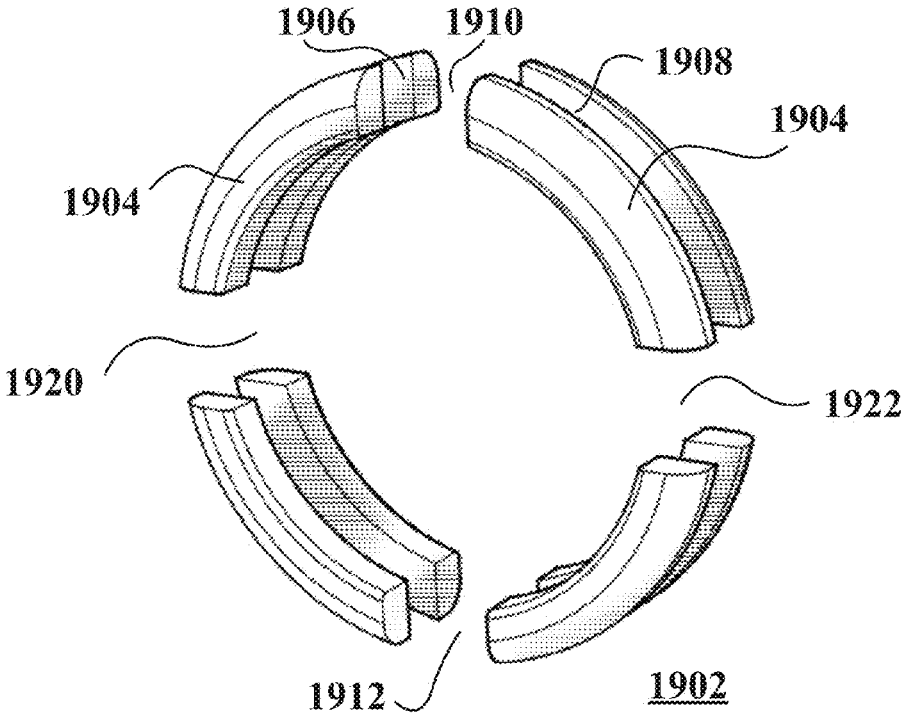
FIG. 20 is a perspective view of a first type material of FIG. 19.

Shown are two types of materials. The first material 1902 is a contemporary material. The second material 1952 is a traditional metal. The traditional metal has a gem 1955 attached to it. Turning to FIG. 20 shown is a perspective view 1902 of a first type material of FIG. 19. The first material 1902 is created in a portion of a substantially circular shape. There are two first C-shaped distal halves 1906, 1916, 1926, 1936. Also there are two second C-shaped proximate halves 1904, 1914, 1924, 1934. A space 1908, 1918, 1928, 1938 between each of the distal-proximate sides 1904 and 1906, 1914 and 1916, 1924 with 1926, and 1934 with 1936. Like the second example, each of the halves arranged together to form a vertically bisected O-shape with a top portion removed defining a first arcuate void portion 1910 and a bottom portion removed defining a second arcuate void portion 1912. Again, like the third example, note that there is a horizontally bisected O-shape with the left portion removed defining a third arcuate void portion 1920, and a right portion removed defining a fourth arcuate void portion 1922.

Figure 21:
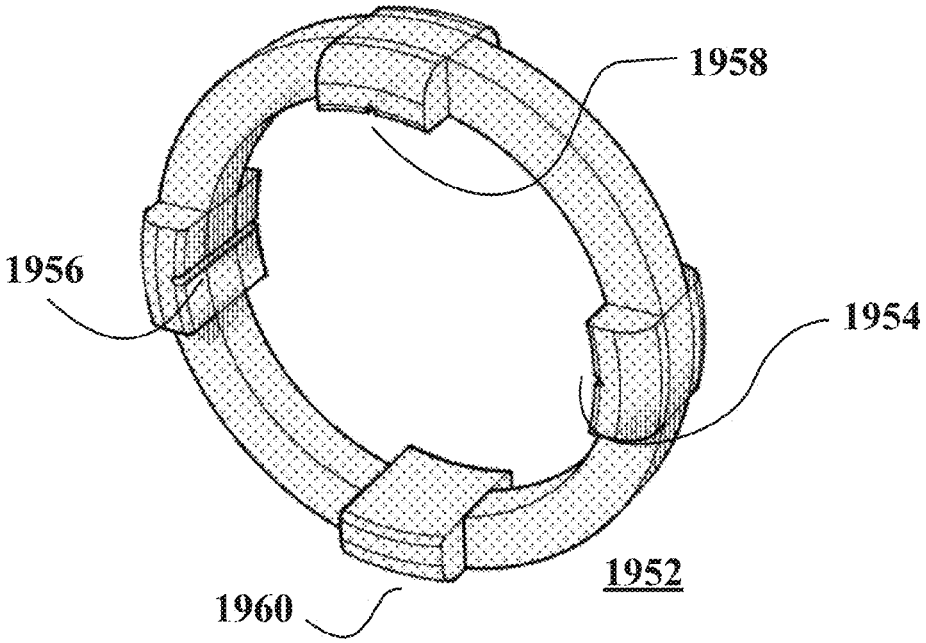
FIG. 21 is a perspective view of a second type material of FIG. 19.

FIG. 21 is a perspective view of a second type material 1952 of FIG. 19. The second material 1952 is created in a substantially circular shape and defines an inner diameter or inner circumference of a given ring size. The second material 1952 is created to fit inside the space 1908, 1918, 1928, 1938 of each of the two first and two second C-shaped halves 1904, 1906, 1914, 1916 of the first material 1902.

The second material includes three stress relief points 1954, 1956, 1958 located at a 9 o'clock position, 12 o'clock position, and 3 o'clock position (90, 180, 270 degrees starting from the bottom). In this example the decorative bars 1964, 1966, 1968 near the stress points 1954, 1956, 1958. The decorative bars 1964, 1966, 1968 are sized to fit inside the first, third, and fourth arcuate void portions 1910, 1920, 1922 of the first material 1902. The mount 1956 may be fastened to the second material 1952 by casting, co-casting, machining, extruding forging, gluing, joining, riveting, stamping, welding, or a combination thereof.

Note that the size bar 1960 sized to fit within the second arcuate void portion 1912 of the first material 1902 at the 6 o'clock position.

The second material 1952 can be created to fit inside the space 1908, 1918, 1928, 1938 and second arcuate void portion 1912 by casting, co-casting, machining, extruding forging, gluing, joining, riveting, stamping, welding, or a combination thereof.

Eighth Example of Resizable Ring

Figure 22:
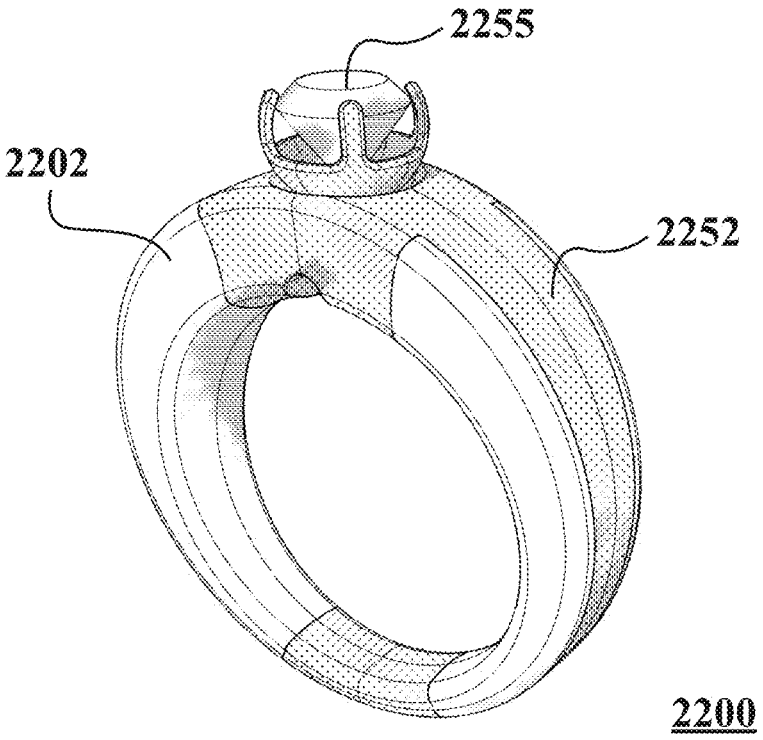
FIG. 22 is a top elevational view of a eighth example of a resizable ring.
Figure 23:
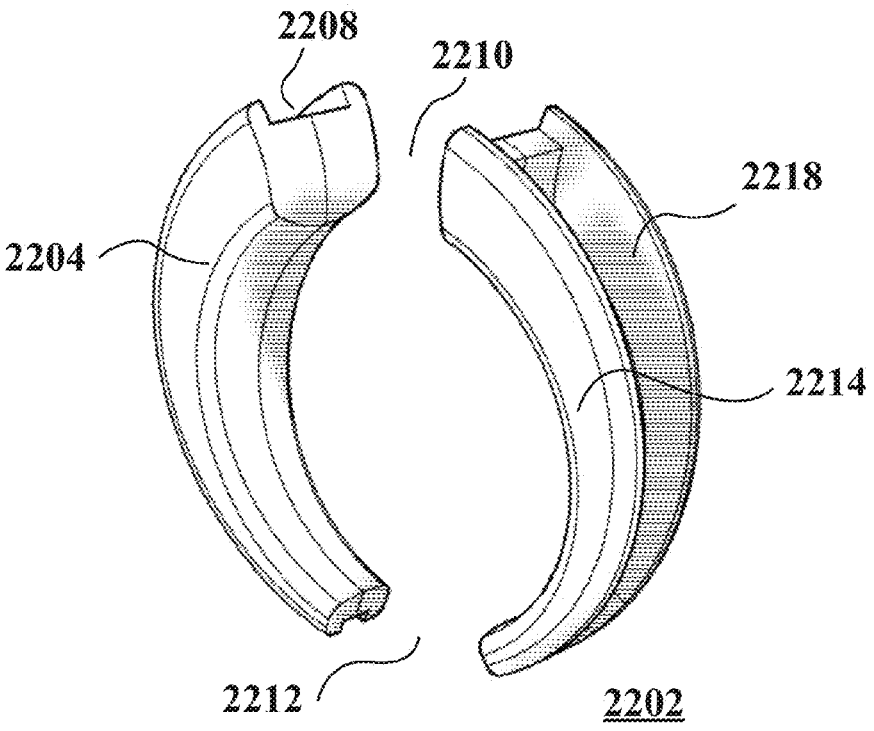
FIG. 23 is a perspective view of a first type material of FIG. 22.

FIG. 22 is a top elevational view of an eighth example of a resizable ring 2200. Shown are two types of materials. The first material 2202 is a contemporary material. The second material 2252 is a traditional metal. The traditional metal has a gem 2255 attached to it. Turning to FIG. 23, shown is a perspective view 2202 of a first type material of FIG. 22. The first material 2202 is created in a portion of a substantially circular shape. There are two first C-shaped halves 2206, 2216. A peripheral channels 2208, 2218 is formed in each of the C-shaped halves 2206, 2216. As shown, each of the halves arranged together to form a vertically bisected O-shape with a top portion removed defining a first arcuate void portion 2210 and a bottom portion removed defining a second arcuate void portion 2212.

Figure 24:
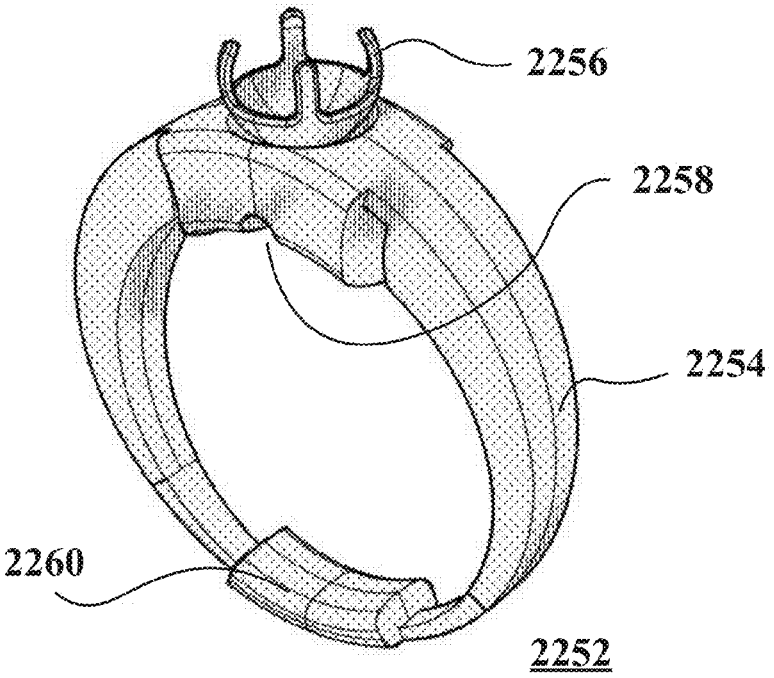
FIG. 24 is a perspective view of a second type material of FIG. 22.

FIG. 24 is a perspective view of a second type material 2252 of FIG. 22. The second material is created in a substantially circular shape and defines an inner diameter or inner circumference of a given ring size. The second material 2252 is created to fit inside the space 2208, 2218 of each of the two first and two second C-shaped halves 2204, 2206 of the first material 2202.

The second material includes a stress relief point 2258 near the mount 2256 located at a 12 o'clock position for the gem 2255. In this example the mount 2256 is sized to fit inside the first arcuate void portion of the first material 2202. The mount 2256 may be fastened to the second material 2252 by casting, co-casting, machining, extruding forging, gluing, joining, riveting, stamping, welding, or a combination thereof.

Note that the size bar 2260 sized to fit within the second arcuate void portion 2212 of the first material 2202 at the 6 o'clock position.

The second material 2252 can be created to fit inside the space 2208, 2211 by casting, co-casting, machining, extruding forging, gluing, joining, riveting, stamping, welding, or a combination thereof.

Ninth Example of Resizable Ring

Figure 25:
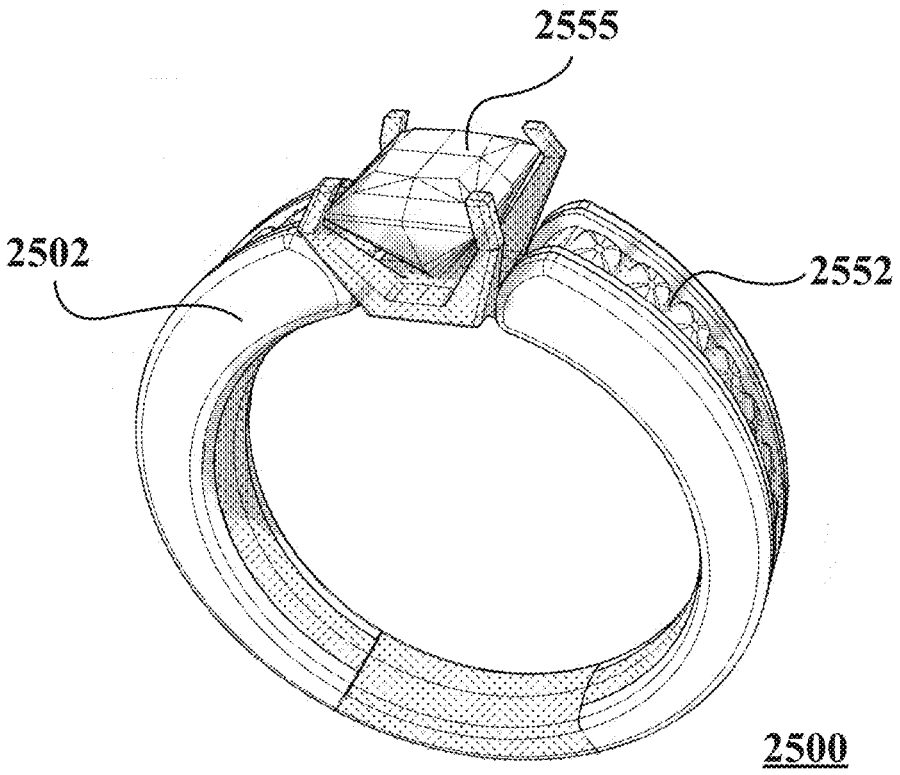
FIG. 25 is a top elevational view of a ninth example of a resizable ring.
Figure 26:
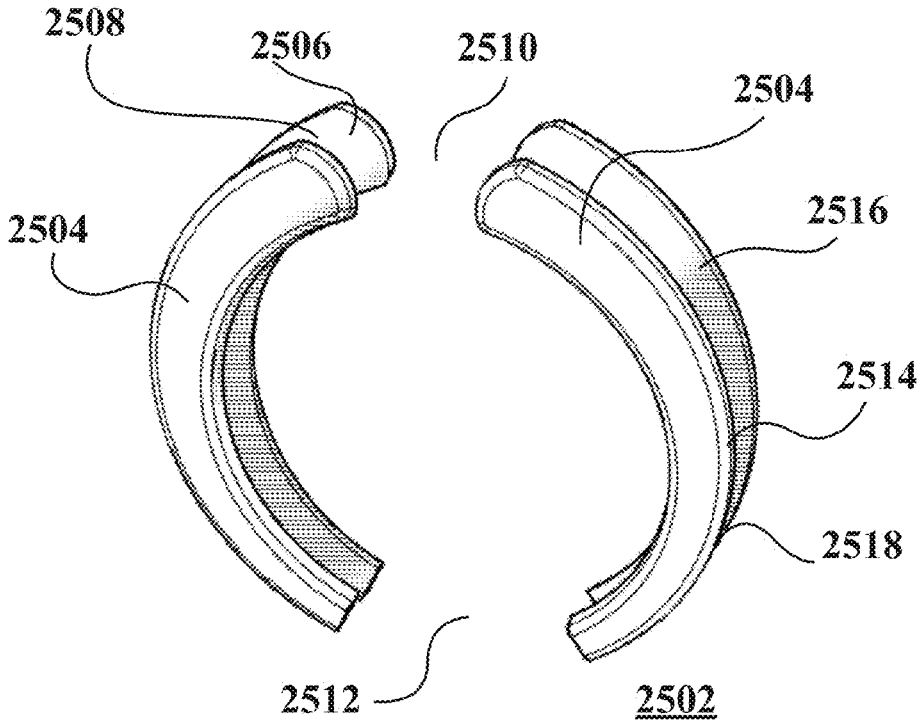
FIG. 26 is a perspective view of a first type material of FIG. 25.

FIG. 25 is a top elevational view of a ninth example of a resizable ring 2500. Shown are two types of materials. The first material 2502 is a contemporary material. The second material 2552 is a traditional metal. The traditional metal has a gem 2555 attached to it. Turning to FIG. 26, shown is a perspective view 2602 of a first type material of FIG. 25. The first material 2502 is created in a portion of a substantially circular shape. There are two first C-shaped halves 2506, 2516. A peripheral channels 2508, 2518 is formed in each of the C-shaped halves 2506, 2516. As shown, each of the halves arranged together to form a vertically bisected O-shape with a top portion removed defining a first arcuate void portion 2510 and a bottom portion removed defining a second arcuate void portion 2512. There is a slight taper in width of the ring from the first arcuate void portion 2510, to the bottom arcuate void portion 2512 as shown.

Figure 27:
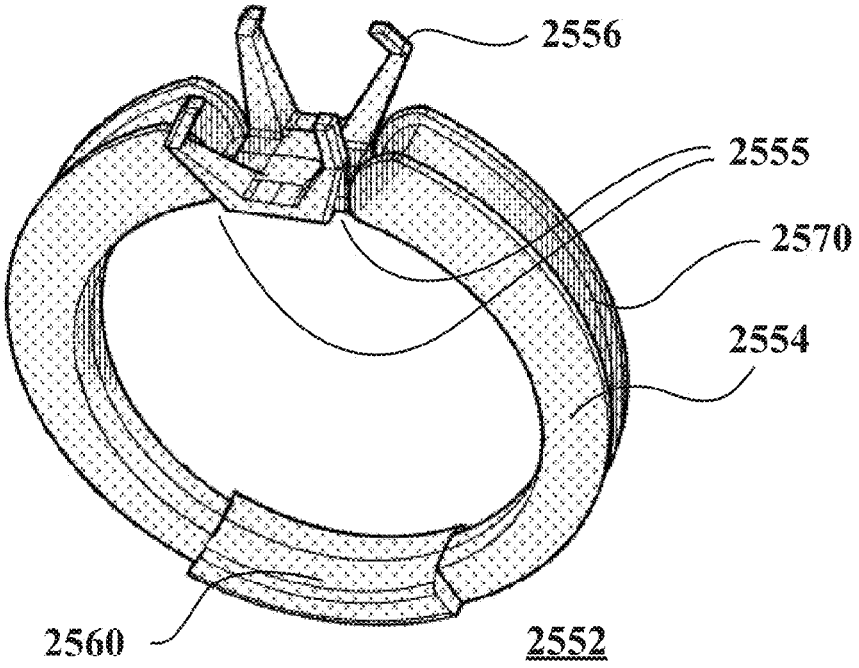
FIG. 27 is a perspective view of a second type material of FIG. 25.

FIG. 27 is a perspective view of a second type material 2552 of FIG. 25. The second material is created in a substantially circular shape and defines an inner diameter or inner circumference of a given ring size. The second material 2552 is created to fit inside the space 2508, 2518 of each of the two first and two second C-shaped halves 2504, 2506 of the first material 2502.

The second material includes a stress relief point 2558 near the mount 2556 located at a 12 o'clock position for the gem 2558. In this example the mount 2556 is sized to fit inside the first arcuate void portion of the first material 2502. The mount 2556 may be fastened to the second material 2552 by casting, co-casting, machining, extruding forging, gluing, joining, riveting, stamping, welding, or a combination thereof.

Note that the size bar 2560 sized to fit within the second arcuate void portion 2512 of the first material 2502 at the 6 o'clock position.

The second material 2552 can be created to fit inside the space 2508, 2511 by casting, co-casting, machining, extruding forging, gluing, joining, riveting, stamping, welding, or a combination thereof.

Tenth Example of Resizable Ring

Figure 28:
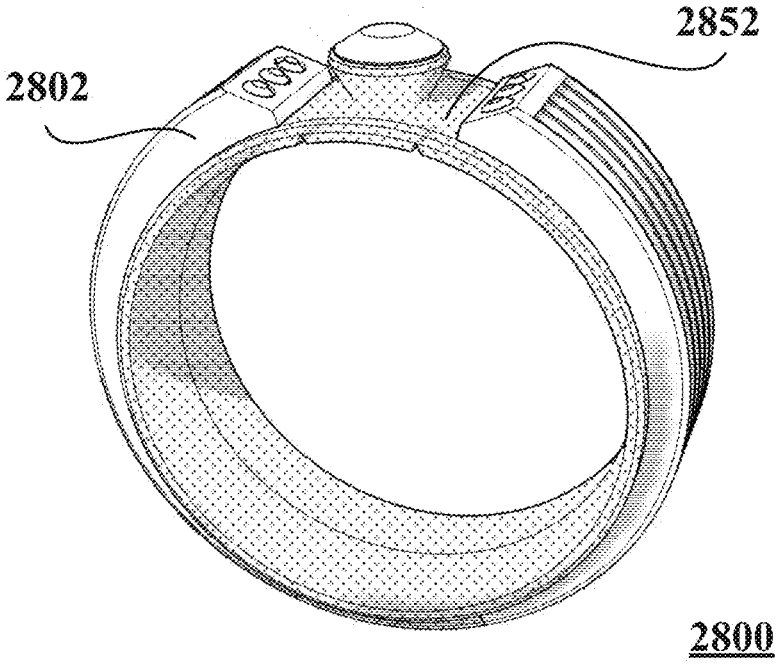
FIG. 28 is a top elevational view of a tenth example of a resizable ring.
Figure 29:
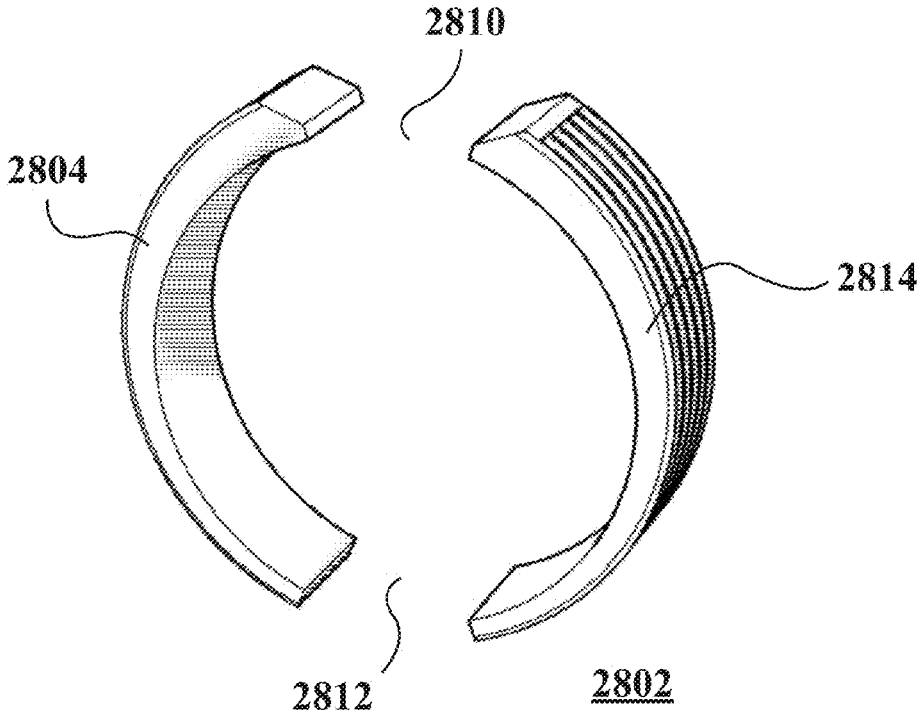
FIG. 29 is a perspective view of a first type material of FIG. 28.
Figure 30:
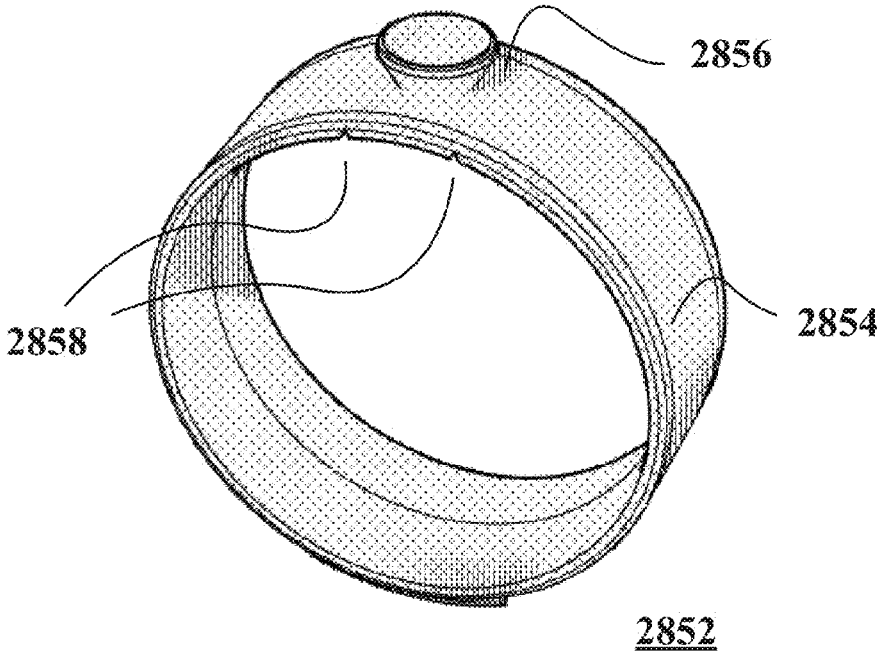
FIG. 30 is a perspective view of a second type material of FIG. 28.

FIG. 28 is a top elevational view of a tenth example of a resizable ring 2800. Shown are two types of materials 2802 and 2852. The first material 2802 is a contemporary material. The second material 2852 is a traditional metal. The traditional metal has a gem 2855 attached to it. Turning to FIG. 29, shown is a perspective view 2802 of a first type material of FIG. 28. The first material 2802 is created in a portion of a substantially circular shape. There are two first C-shaped halves 2804, 2806. As shown, each of the halves arranged together to form a vertically bisected O-shape with a top portion removed defining a first arcuate void portion 2810 and a bottom portion removed defining a second arcuate void portion 2812. FIG. 30 is a perspective view 2852 of a second type material of FIG. 28. The second material 2852 is created in a substantially circular shape and defines an inner diameter or inner circumference of a given ring size. The second material 2856 is formed as a substantially circular shape with an outside perimeter channels. The bottom part is a size bar 2860 sized to fit within the second arcuate void portion 2812. The mount 2856 for a gem 2855 sized to fit within first arcuate void portion 2810 of the first material 2802. The second material 2852 includes a stress relief point 2858 at a 12 o'clock position near the mount 2856 for the gem 2855.

The second material 2852 can be created to around the first material 2810 by casting, co-casting, machining, extruding forging, gluing, joining, riveting, stamping, welding, or a combination thereof.

Non-Limiting Examples

The description of the present application has been presented for purposes of illustration and description, but is not intended to be exhaustive or limited to the invention in the form disclosed. Many modifications and variations will be apparent to those of ordinary skill in the art without departing from the scope and spirit of the invention. For example, more than one contemporary or traditional metal can be used in any of the examples described herein. The examples or embodiment were chosen and described in order to best explain the principles of the invention and the practical application, and to enable others of ordinary skill in the art to understand the invention for various embodiments with various modifications as are suited to the particular use contemplated.

What is claimed is:

1. A resizable ring comprising:

a first material created to form at least a portion of a substantially circular shape from a first C-shaped half, and a second C-shaped half, and each half arranged together to form a vertically bisected O-shape with a top portion removed defining a first arcuate void portion and a bottom portion removed defining a second arcuate void portion the first material formed with an outer circumference and an inner circumference; and a second material which is substantially O-shape and that is more ductile than the first material with at least one stress relief point and at least one size bar disposed in at least one of the first arcuate void portion and the second arcuate void portion, the second material disposed within the inner circumference of the first material including both the first arcuate void portion and the second arcuate void portion thereof, wherein the stress relief point is formed having at least one of a notch, a groove, a slit, a void, or a thinner section;

wherein the second material enables a ring size to be enlarged or decreased when a combination of the at least one size bar is altered and the second material is bent at the stress relief point.

2. The resizable ring of claim 1, wherein the second material is formed to define a complete O-shape, created to fit inside each of the two first and two second C-shaped halves of the first material is created using any of casting, co-casting, machining, extruding forging, gluing, joining, riveting, stamping, welding, or a combination thereof.

3. The resizable ring of claim 1, wherein the first material is a contemporary material defined as at least one of one carbide, ceramic, chrome cobalt, niobium, platifina, rhodium, steel, stainless steel, surgical stainless steel, titanium, tantalum, tungsten, zirconium, or a combination thereof, and the second material is a ductile metal defined as at least one of brass, bronzed, copper, gold, palladium, platinum, silver, steel, or a combination thereof.

4. The resizable ring of claim 3, wherein the size bar is sized to fit within the second arcuate void portion of the first material.

5. The resizable ring of claim 1, where in the second material is created inside each of the first C-shaped half and the second C-shaped half of the first material casted to form a substantially circular shape.

6. The resizable ring of claim 5, further comprising at least one gem disposed on the second material and sized to fit within the first arcuate void portion of the first material.

7. The resizable ring of claim 6, further comprising a plurality of gem stones disposed on the second material and at least one gem stone sized to fit within the first arcuate void portion of the first material.

8. The resizable ring of claim 6, wherein the at least one stress relief point includes three stress relief points located at 90 degrees from the size bar, 180 degrees from the size bar, and 270 degrees from the size bar.

9. The resizable ring of claim 1, wherein the first material and the second material when created inside form an inner diameter of a given ring size.

* * * * *